US005989801A

United States Patent [19]

Hirosawa et al.

[11] Patent Number: 5,989,801

[45] Date of Patent: Nov. 23, 1999

[54] SILVER HALIDE PHOTOGRAPHIC MATERIAL AND METHOD FOR FORMING IMAGE

[75] Inventors: Toshio Hirosawa; Kouji Katsube; Toshiko Nakamura; Yoshiro Hayafuchi; Katsuyuki Arasawa, all of Kanagawa, Japan

[73] Assignee: Oriental Photo Industrial Co., Ltd., Hiratsuka, Japan

[21] Appl. No.: 09/140,829

[22] Filed: Aug. 26, 1998

[30] Foreign Application Priority Data

Nov. 11, 1997 [JP] Japan ..... 9-325292

[51] Int. Cl.[6] ..... G03C 1/30

[52] U.S. Cl. ..... 430/626; 430/364; 430/376; 430/377; 430/549; 430/551; 430/565; 430/613

[58] Field of Search ..... 430/549, 551, 430/565, 613, 626

[56] References Cited

U.S. PATENT DOCUMENTS

| | | | |
|---|---|---|---|
| H583 | 2/1989 | Asami | 430/550 |
| 4,315,069 | 2/1982 | Scott et al. | 430/365 |
| 4,348,474 | 9/1982 | Scheerer et al. | 430/506 |
| 4,411,987 | 10/1983 | Kobayashi et al. | 430/542 |
| 4,839,263 | 6/1989 | Miyoshi et al. | 430/551 |
| 4,894,318 | 1/1990 | Arakawa et al. | 430/551 |
| 5,362,616 | 11/1994 | Edwards et al. | 430/549 |

FOREIGN PATENT DOCUMENTS

| | | |
|---|---|---|
| 0 087 984 A2 | 9/1983 | European Pat. Off. . |
| 0 243 202 A2 | 10/1987 | European Pat. Off. . |
| 0 255 784 A2 | 2/1988 | European Pat. Off. . |
| 2 157 840 | 10/1985 | United Kingdom . |
| WO 93/12465 | 6/1993 | WIPO . |

*Primary Examiner*—Hoa Van Le

*Attorney, Agent, or Firm*—Flynn, Thiel, Boutell & Tanis, P.C.

[57] ABSTRACT

The present invention provides a silver halide photographic material and an image forming method for obtaining a monochrome image using a dye image even if it is treated with a color developer free of benzyl alcohol; a photographic property of the monochrome image is less deteriorated by a toxic gas such as formaldehyde and an increase in sensitization and fog with time is improved.

A silver halide photographic material comprising a support, at least one silver halide emulsion layer on the support and at least one non-photosensitive hydrophilic colloidal layer, in which a silver halide grain of the silver halide emulsion layer includes not less than 95% mol of silver halide and in which the silver halide emulsion layer includes a yellow coupler, a magenta coupler, a cyan coupler and a specific formalin scavenger and the silver halide emulsion layer and/or the non-photosensitive hydrophilic colloidal layer include a specific s-triazine type compound and a method for forming an image by developing the silver halide photographic material with a color developer substantially free of benzyl alcohol.

5 Claims, No Drawings

SILVER HALIDE PHOTOGRAPHIC MATERIAL AND METHOD FOR FORMING IMAGE

BACKGROUND OF THE INVENTION

1. Field of the Invention

The present invention relates to a silver halide photographic material and a method for forming an image by developing the material, and particularly relates to a monochrome photographic material involving the use of dye images which can be processed with a color developer substantially free from benzyl alcohol, has a photographic property that is less deteriorated by a toxic gas such as formaldehyde, has an improved sensitization and fog with time, and relates to a method for forming an image.

2. Description of the Related Art

Monochrome images are developed from conventional silver images using a monochrome developing agent such as hydroquinone. There is a few laboratories and photo studios where such development can be conducted. Color paper is generally developed with a color developer substantially free of benzyl alcohol. A treating machine suitable for the color development is widely used in the laboratories and photo studios. It is desirable that a material for forming the monochrome images is applied to the color development.

It is known that a photographic system of forming the monochrome images utilizing a combination of cyan, magenta and yellow dyes (see, for example, WO 93/12465 corresponding to U.S. Pat. No. 5,362,616 and JP-A No. 6-505580). In the system, dyes are formed from a mixture of cyan, magenta and yellow couplers during the development. When reacting with an oxidized color developing agent, the couplers produce a neutral (black-and-white) image.

Recently, furniture and building materials reformed by formaldehyde, adhesives utilized formaldehyde as a curing agent, formaldehyde resin manufactured products, leather tanned by formaldehyde, clothing used formaldehyde as a bactericide and a bleaching agent are widely used. There are many chances that the photographic materials are contacted with a formaldehyde gas.

The present inventors discovered that a magenta coupler is affected by the formaldehyde gas even in a photographic system where a combination of a cyan dye, a magenta dye and a yellow dye is used to form a monochrome image. For example, if the above-described photographic materials are stored in a cassette made of a formalin resin, photographic properties are degraded by the formalin.

The present inventors discovered that a formalin scavenger is used to improve the degradation. However, the present inventors also found that the formalin scavenger sensitizes a portion of the photographic materials contacted with air, for example, an outermost surface or a side rim of a roll-shaped photographic material. Such phenomenon destroys an image balance upon exposure and development of the photographic material and is therefore not preferable.

An object of the present invention is to provide a silver halide photographic material for obtaining a monochrome image with a dye image where a magenta coupler is less affected by the formaldehyde gas.

Another object of the present invention is to provide a silver halide photographic material preventing sensitizing of a portion contacted with air for a while and decreasing fog.

Still another object of the present invention is to provide a method for forming a monochrome image with a dye image by developing it with a color developer substantially free of benzyl alcohol.

DISCLOSURE OF THE INVENTION

To be solved the problems, the present invention provides a silver halide photographic material, comprising a support and at least one silver halide emulsion layer and at least one non-photosensitive hydrophilic colloidal layer, both provided on the support, silver halide grains of the silver halide emulsion layer including not less than 95% mol of silver chloride, the silver halide emulsion layer including a yellow coupler, a magenta coupler, a cyan coupler and at least one of the following compounds represented by the formula (I) or (II):

formula (I)

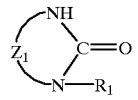

wherein $R_1$ represents a hydrogen atom, an alkyl group having 1 to 4 carbon atoms or an acyl group and $Z_1$ represents an ethylenic chain or a trimethine chain, formula (II)

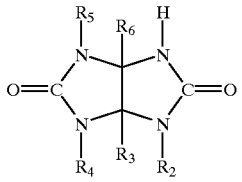

wherein $R_2$ to $R_6$ represent a hydrogen atom, an alkyl group having 1 to 4 carbon atoms, an aryl group or an aralkyl group, at least one of the silver halide emulsion layer and the non-photosensitive hydrophilic colloidal layer including at least one of the following compounds represented by the formula (III) or (IV):

formula (III)

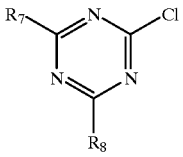

wherein $R_7$ represents a chlorine atom, a hydroxy group, an alkyl group, an alkoxy group, an alkylthio group, an —OM group, M being a monovalent metal atom, $—NR_9R_{10}$ group or $—NHCOR_{11}$ group, $R_9$, $R_{10}$ or $R_{11}$ being a hydrogen atom, an alkyl group or an aryl group; $R_8$ represents the same as $R_7$ except the chlorine atom, formula (IV)

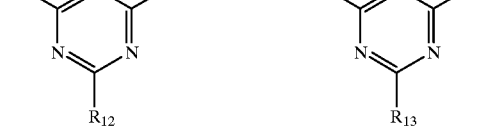

wherein $R_{12}$ and $R_{13}$ represent a chlorine atom, a hydroxy group, an alkyl group, an alkoxy group or an —OM group, M being a monovalent metal atom, $Q_1$ and $Q_2$ represent —O—, —S—or —NH—, and L represents an alkylene group or an arylene group, $n_1$ and $n_2$ represent 0 or 1. The couplers are dye-forming couplers.

Secondary, the present invention provides the material according to the above-mentioned silver halide photographic material, wherein the non-photosensitive hydrophilic colloidal layer includes at least one of the compounds represented by the formula (I) or (II).

Thirdly, the present invention provides the material according to one of the above-mentioned silver halide photographic material, which comprises the support, the emulsion layer, provided on the support and the colloidal layer, provided on the emulsion layer.

Fourthly, the present invention provides the material according to the firstly-mentioned silver halide photographic material, which comprises the support, the colloidal layer, provided on the support, and the emulsion layer, provided on the colloidal layer.

Fifthly, the present invention provides a method for forming an image by comprising steps of exposing the material as defined in the firstly- or secondary- mentioned silver halide photosensitive material to image-carrying light and developing the material with a color developer substantially free of benzyl alcohol.

Regarding a halogenated composition in the silver halide emulsion used in the present invention, it is preferred that silver halide grains comprise not less than 95 mol % of silver chloride and comprise silver chloride/bromide substantially free of silver iodide.

An average grain size of the silver halide grains (an average diameter of sphere or sphere-like grains, or an average ridge length of cube grains based on a projected area) is not especially limited, but is preferably not more than 3 $\mu$m.

The grain size distribution may be narrow or wide.

The silver halide grains may have a regular crystal form such as cube and octahedron, an anomalous crystal form such as sphere and tabular plate, a composite thereof or a mixture of grains having various crystal forms.

An emulsion in which tabular silver halide grains having a diameter of five times or more larger than a thickness thereof occupy not less than 50% of the total projected area may be used.

The grains may have a latent image mainly formed on surfaces thereof or inside the grains.

The silver halide grains may have a laminated structure comprising different halogenated compositions on the inside and the outside of the grains or may be bonded with other silver halide grains having different halogen compositions by an epitaxial bonding.

In the silver halide grains of the silver halide emulsion according to the present invention, it is preferred that a localized layer containing 30 to 60 mol % of silver bromide is epitaxially grown locally on the surfaces, especially corners of the halogenated grains. The localized layer is preferably composed of 0.5 to 5% of silver based on the total weight of the silver constituting the silver halide grains. A method for producing the epitaxial silver halide grains is described in EP-A No. 273,430.

The silver halide emulsion employed in the present invention can be prepared by using a method described in P. Glafkides, Chimie et Physique Photographique (Paul Montel, 1967), G. F. Duffin, Photographic Emulsion Chemistry (The Focal Press, 1966), V. L. Zelikman et al, Making and Coating Photographic Emulsion (The Focal Press, 1964) or the like. In other words, any of an acid process, a neutral process, an ammonia process and the like can be used. As a method of reacting a soluble silver salt with a soluble halogen salt, any conventional mixing method may be used, such as the normal order of introducing the silver salt into the halogen salt, a reversed order thereto, a simultaneous mixing and a combination thereof.

As one of the simultaneous mixing, a method for keeping constantly pAg in the solution of the silver halide and a so-called control double jet method can be used. According to the method, a silver halide emulsion having a regular crystal form and an approximately uniform grain size can be obtained.

Two or more of silver halide emulsions separately formed may be mixed for use.

During a formation or a physical ripening of the silver halide grains, a cadmium salt, a zinc salt, a lead salt, a thallium salt, an iridium salt or a complex salt thereof, a rhodium salt or a complex salt thereof, an iron salt or a complex salt may coexist.

The silver halide emulsion may be chemically sensitized in a conventional way. For example, a sulfur sensitizing method utilizing an active gelatin and a compound containing a reactive sulfur with silver, such as a thiosulphate, thio-ureas, a mercapto compound and rhodanine compounds, a reducing sensitizing method utilizing a reducing substance such as a stannous salt, amines, a hydrazine derivative, a formamidine sulfinic acid and a silane compound, or a noble metal-sensitizing method utilizing a noble metal compound such as a complex salt of a metal such as gold, platinum, iridium and palladium may be used alone or in combination.

The compound represented by the formula (I) or (II) will be described below.

formula (I)

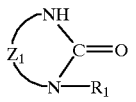

wherein $R_1$ represents a hydrogen atom, an alkyl group having 1 to 4 of carbon atoms (i.e., a methyl group, an ethyl group, a propyl group, an ethoxymethyl group) or an acyl group (i.e., an acetyl group, a benzyl group), and $Z_1$ represents an ethylenic chain or a trimethine chain.

formula (II)

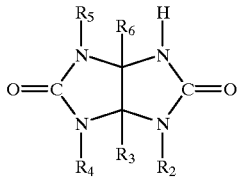

wherein $R_2$ to $R_6$ represent a hydrogen atom, an alkyl group having 1 to 4 of carbon atoms (i.e., a methyl group, an ethyl group, a propyl group) or an aryl group (i.e., a phenyl group), and aralkyl group (i.e., a benzyl group).

Examples of the compound represented by the formula (I) or (II) is as follows:

I-1

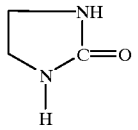

I-2

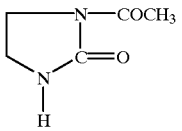

I-3

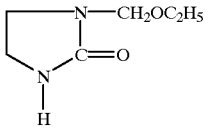

I-4

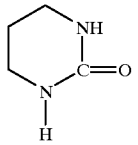

II-1

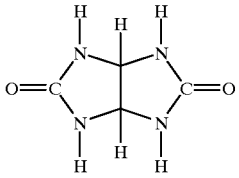

II-2

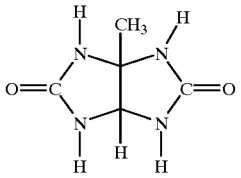

II-3

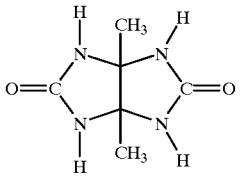

II-4

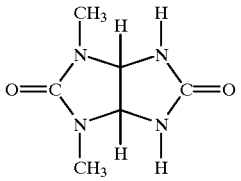

II-5

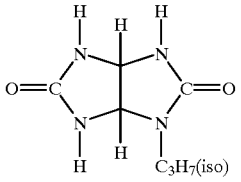

-continued

II-6

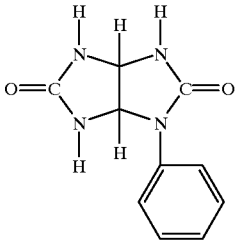

II-7

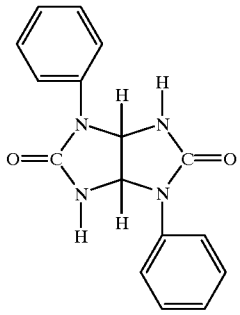

II-8

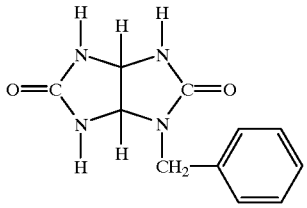

The above-described compounds are commercially available and can also be synthesized by a method described in U.S. Pat. Nos. 3,187,004 and 3,242,044.

One or more of the compounds represented by the formula (I) or (II) are contained in a silver halide emulsion layer containing a yellow coupler, a magenta coupler and a cyan coupler, or both of the silver halide emulsion layer and a non-photosensitive hydrophilic colloidal layer. Examples of the non-photosensitive hydrophilic colloidal layer of the present invention includes a protective layer, an intermediate layer, a ultraviolet ray absorbing layer, a yellow filter layer, an antihalation layer, an antistatic layer or the like. A preferred layer of the non-photosensitive hydrophilic colloidal layer containing the compound represented by the formula (I) or (II) is a layer which is nearest to outside air in the photosensitive material, i.e., the protective layer.

In order to add and introduce the compound represented by the formula (I) or (II) of the present invention to these layers, the compound may be dissolved in a suitable solvent such as water and methanol to add to a coating solution for forming a layer at any stage, generally at the same time when other additives are added or desirably directly before coating.

An additive amount of the compound to the silver halide emulsion layer is in the range of 0.1 g to 1.0 g per 1 $m^2$, 0.1 g to 1.0 g in the non-photosensitive hydrophilic colloidal layer, 0.1 g to 2.0 g in the whole photographic material to provide a preferred effect.

The compound represented by the formula (III) or (IV) will be described.

formula (III)

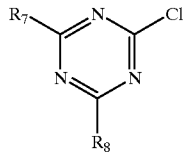

wherein $R_7$ represents a chlorine atom, a hydroxyl group, an alkyl group (i.e., a methyl group, an ethyl group, a butyl group), an alkoxy group (i.e., a methoxy group, an ethoxy group, a butoxy group), an alkylthio group, an —OM group (in which M is a monovalent metal atom, i.e., a sodium atom, a potassium atom), —$NR_9R_{10}$ group or —$NHCOR_{11}$ group (in which Rg, $R_{10}$ or $R_{11}$ represents a hydrogen atom, an alkyl group or an aryl group); $R_8$ represents the same as $R_7$ except the chlorine atom.

The compound represented by the formula (III) is described in U.S. Pat. No. 3,645,743, JP-B No. 47-6151, No. 47-33380 and No. 51-9607.

formula (IV)

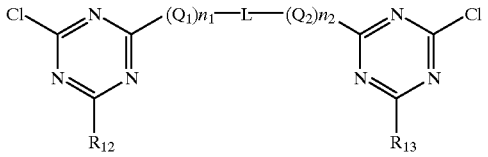

wherein $R_{12}$ and $R_{13}$ represent a chlorine atom, a hydroxyl group, an alkyl group (i.e., a methyl group, an ethyl group, a butyl group), an alkoxy group (i.e., a methoxy group, an ethoxy group, a buthoxy group) or an —OM group (in which M is a monovalent metal atom, i.e., a sodium atom, a potassium atom), $Q_1$ and $Q_2$ represent —O—, —S—or —NH—, and L represents an alkylene group (i.e., a methylene group, an ethylene group, a propylene group) or an arylene group (i.e., o-, m- or p-phenylene group). $n_1$ and $n_2$ represent 0 or 1.

The compound represented by the formula (IV) is described in JP-B No. 58-33542 and JP-A No. 57-40244.

The compound represented by the formula (III) and (IV) of the present invention is dissolved in water or alcohol (i.e., methyl alcohol, ethyl alcohol) to add in an amount of 1 to 100 mg, preferably 5 to 50 mg per 1 g of gelatin. A method for adding may be a batch mode or an in-line mode, preferably the in-line mode of adding directly before coating.

Examples of the compound represented by the formula (III) or (IV) are as follows:

III-1

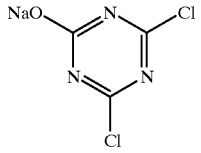

-continued

III-2

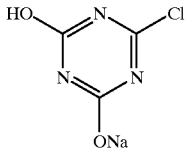

III-3

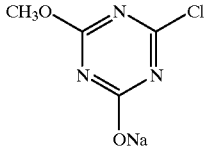

III-4

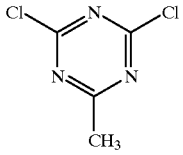

III-5

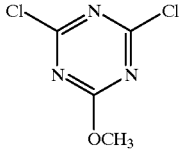

III-6

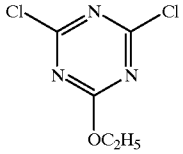

III-7

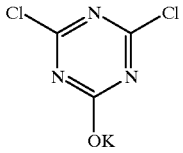

III-8

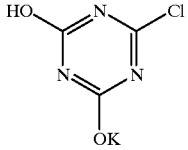

III-9

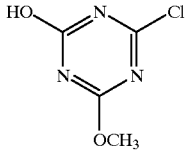

III-10

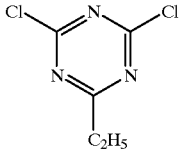

-continued

III-11

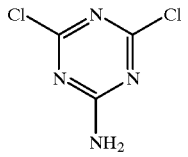

III-12

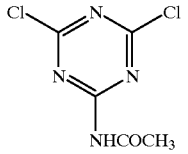

III-13

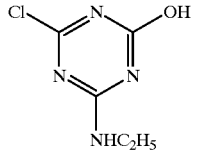

IV-1

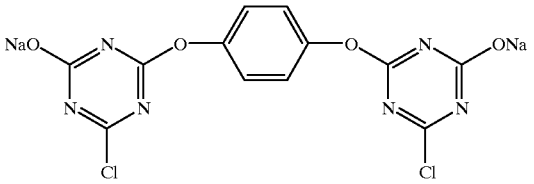

IV-2

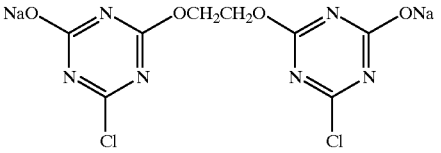

IV-3

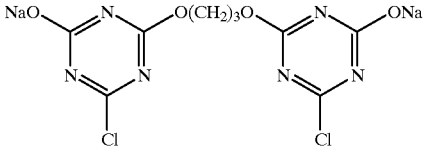

IV-4

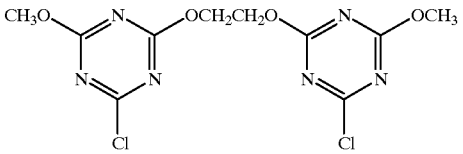

IV-5

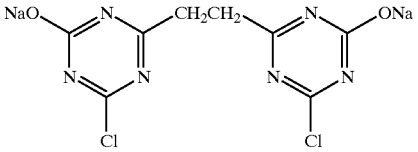

IV-6

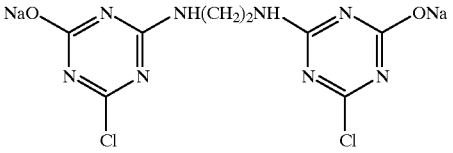

-continued

IV-7

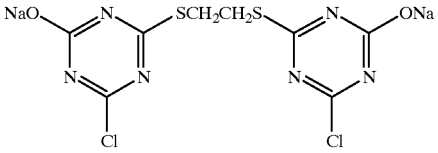

IV-8

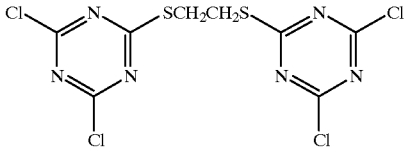

IV-9

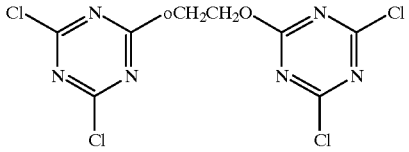

The silver halide emulsion of the present invention is preferably spectral sensitized with at least one sensitizing dye represented by the formula (V), at least one sensitizing dye represented by the formula (VI) and at least one sensitizing dye represented by the formula (VII) or (VIII).

formula (V)

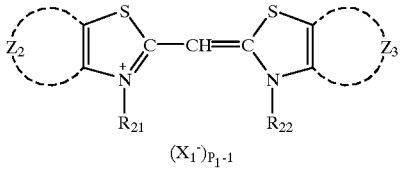

$(X_1^-)_{p_1-1}$ formula (VI)

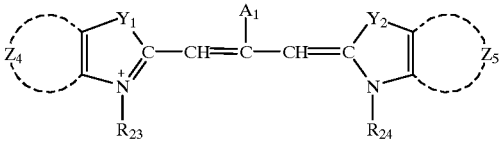

$(X_2^-)_{p_2-1}$ formula (VII)

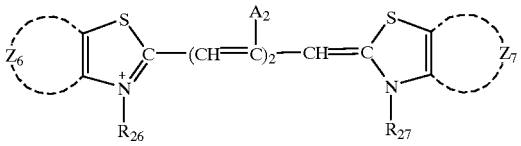

$(X_3^-)_{p_3-1}$ formula (VIII)

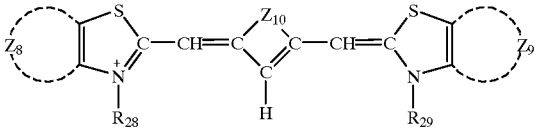

$(X_4^-)_{q-1}$

In the formula (V), wherein $R_{21}$ and $R_{22}$ represent an alkyl group having 1 to 6 of carbon atoms (i.e., a methyl group, an ethyl group, an n-propyl group, an isopropyl group, an n-butyl group, an isobutyl group, an n-hexyl group, an isohexyl group), a substituted alkyl group having 1 to 4 of carbon atoms [for example, a hydroxyl alkyl group (i.e., a 2-hydroxyl ethyl group, a 3-hydroxy propyl group, a 2-hydroxy propyl group), a sulfo alkyl group (i.e., a 2-sulfo ethyl group, a 3- sulfo propyl group, a 3-sulfo butyl group, a 4-sulfo butyl group), a carboxyl alkyl group (i.e., a 2-carboxyl ethyl group, a 3-carboxy propyl group, a 3-carboxy butyl group, a 4-carboxy butyl group)], an aralkyl group (i.e., a benzyl group, a 2-phenylethyl group). Preferably either one of $R_{21}$ and $R_{22}$ represent the substituted alkyl group. $Z_2$ and $Z_3$ represent non-metal atoms that are required to form a benzene nucleus or a naphthalene nucleus which may have a substituted group (i.e., a halogen atom, an alkyl group, an alkoxy group, an aryl group, a cyano group, an alkoxy carbonyl group, a trifluoromethyl group, an alkyl sulfonyl group, an alkyl sulfamoyl group, an acyl amino group, an alkyl carbamoyl group, an acetoxy group). $X_1$ represents an anionic group generally employed (i.e., a chloride ion, a bromide ion, an iodide ion, a perchlorate acid ion, a p-toluene sulfonate ion, an ethylsufate acid ion). $P_1$ represents 1 or 2, with a proviso that when $P_1$ is 1, an intermolecular salt is formed.

In the formula (VI), wherein $R_{23}$ and $R_{24}$ represent an alkyl group having 1 to 6 of carbon atoms that may have a sulfo group as a substituted group (i.e., a methyl group, an ethyl group, a n-propyl group, an isopropyl group, a n-butyl group, an isobutyl group, a n-hexyl group, a 2-sulfoethyl group, a 3-sulfo propyl group, a 3-sulfobutyl group), $A_1$ represents a hydrogen atom, an alkyl group having 1 to 3 carbon atoms (i.e., a methyl group, an ethyl group, a n-propyl group, an isopropyl group) and an aryl group (i.e., a phenyl group), $Y_1$ and $Y_2$ represent a sulfur atom, an oxygen atom, a selenium atom, and N—$R_{25}$, and $R_{25}$ represents an alkyl group having 1 to 3 carbon atoms (i.e., a methyl group, an ethyl group, an n-propyl group, an isopropyl group). $Z_4$ and $Z_5$ represent non-metal atoms that are required to form a benzene nucleus or a naphthalene nucleus which may have a substituted group (i.e., a halogen atom, an alkyl group, an alkoxy group, an aryl group, a carbonyl group, an alkoxy carbonyl group, a cyano group). $X_2$ represents an anionic group (i.e., a chlorine ion, a bromine ion, an iodine ion, a perchlorate ion, a p-toluene sulfonate ion, an ethylsufate acid ion). $P_2$ represents 1 or 2, with a proviso that when $P_2$ is 1, an intermolecular salt is formed.

In the formula (VII) or (VIII), wherein $R_{26}$, $R_{27}$, $R_{28}$ and $R_{29}$ represent an alkyl group having 1 to 6 of carbon atoms (i.e., a methyl group, an ethyl group, a n-propyl group, an isopropyl group, a n-butyl group, an isobutyl group, an n-hexyl group, an isohexyl group), a substituted alkyl group having 1 to 4 of carbon atoms [for example, a hydroxyl alkyl group (i.e., a 2-hydroxyl ethyl group, a 3-hydroxy propyl group, a 2-hydroxy propyl group), a sulfo alkyl group (i.e., a 2-sulfo ethyl group, a 3- sulfo propyl group, a 3-sulfo butyl group, a 4-sulfo butyl group), a carboxyl alkyl group (i.e., a 2-carboxyl ethyl group, a 3-carboxy propyl group, a 3-carboxy butyl group, a 4-carboxy butyl group)], an aralkyl group (i.e., a benzyl group, a 2-phenylethyl group). Preferably, either one of $R_{26}$ and $R_{27}$ is the substituted alkyl group. Also, preferably either one of $R_{28}$ and $R_{29}$ is the substituted alkyl group. $A_2$ represents a hydrogen atom, an alkyl group having 1 to 3 carbon atoms (i.e., a methyl group, an ethyl group, an n-propyl group, an isopropyl group) and an aryl group (i.e., a phenyl group). $Z_6$, $Z_7$, $Z_8$ and $Z_9$ represent non-metal atoms that are required to form a benzene nucleus or a naphthalene nucleus which may have a substituted group (i.e., a halogen atom, an alkyl group, an alkoxy group, an aryl group, a cyano group, an alkoxy carbonyl group, a trifluoromethyl group, an alkyl sulfonyl group, an alkyl sulfamoyl group, an acyl amino group, an alkyl carbamoyl group, an acetoxy group). $Z_{10}$ represents non-metal atoms that are required to form a six member ring nucleus which may have a substituted group (i.e., an alkyl group). $X_3$ and $X_4$ represent an anionic group generally employed (i.e., a chloride ion, a bromide ion, an iodide ion, a perchlorate ion, a p-toluene sulfonate ion, an ethylsufate acid ion). $P_3$ and q represent 1 or 2, with a proviso that when $P_3$ and q are 1, an intermolecular salt is formed.

Examples of these sensitizing dyes are described in JP-A 10-20432 (corresponding to U.S. Pat. No. 5,728,511).

These sensitizing dyes have a concentration of $10^{-6}$ to $10^{-3}$ mol per 1 mol of the silver halide in the silver halide emulsion. Upon adding such sensitizing dyes to the silver halide emulsion, the sensitizing dyes may be directly dispersed into the silver halide emulsion, or may be dissolved in a suitable solvent such as methyl alcohol, ethyl alcohol, acetone, N,N-dimethyl formamide, ethyl acetate, a mixture thereof, or these solvent containing a surfactant to add to the silver halide emulsion.

These sensitizing dyes can be added to the silver halide emulsion upon the formation or after the physical ripening of the silver halide grains. Preferably, the silver halide emulsion is added after the physical ripening, before a chemical ripening, during the chemical ripening, or after the chemical ripening. These sensitizing dyes may be used singly or in combination. The combination of the sensitizing dyes is often used especially for a purpose of supersensitization.

The emulsion may contain, in addition to the above sensitizing dyes, a dye which does not exhibit any spectral sensitization effect in itself or a substance which scarcely absorbs visible light but exhibits a supersensitization effect. For example, the dye and the substance include an aminostyryl compound substituted by a heterocyclic ring containing nitrogen (i.e., a compound described in U.S. Pat. Nos. 2,933,390 and 3,635,721), an aromatic organic acid formaldehyde condensate (i.e., a compound described in U.S. Pat. No. 3,743,510), a cadmium salt, an azaindene compound or the like.

An example of the yellow coupler employed in the present invention includes an oil protect acylacetamide type coupler. Specific examples are described in U.S. Pat. Nos. 2,407,210, 2,875,057 and 3,265,506. Preferably, the two equivalent yellow coupler may be used for the present invention. For example, an oxygen atom eliminated yellow coupler is described in U.S. Pat. Nos. 3,408,194, 3,447,928, 3,933,501 and 4,401,752 and a nitrogen atom eliminated yellow coupler described in JP-B No. 58-10739, U.S. Pat. Nos. 4,022,620 and 4,326,024, Research Disclosure No. 18,053 (April, 1987), GB patent No. 1,425,020, DE-A No. 2,219,917, No. 2,261,361, No. 2,329,587 and No. 2,433,812. An α-pivaloyl acetanilide coupler has fastness of formed dyes and an α-benzoyl acetanilide coupler has an excellent coupling property.

Examples of the magenta coupler used for the present invention includes an oil protect indazolone or cyano acetyl type, preferably a pyrazoloazole type coupler such as 5-pyrazolone type and pyrazotoriazole type. The 5-pyrazolone type coupler is preferably substituted a third position with an aryl amino group or an acyl amino group in view of hue of the formed dyes and the rate of coupling. Such couplers are described in U.S. Pat. Nos. 2,311,082, 2,343,703, 2,600,788, 2,908,573, 3,062,653, 3,152,896 and 3,936,015. The use of a two equivalent 5-pyrazolone type coupler is especially preferred. An example of an elimination group includes a nitrogen atom eliminated group described in U.S. Pat. No. 4,30,619, and an arylthio group described in U.S. Pat. No. 4,351,897. A 5-pyrazolone type coupler having a ballast group described in EP Patent No. 73,636 has high coupling reactivity and thus is preferable. Examples of the pyrazoloazole type coupler includes pyrazolo [1,5-b][1,2,4] triazoles described in EP Patent No. 119,860, pyrazolo benzimidazoles described in U.S. Pat. No. 3,369,897, pyrazolo tetrazoles described in Research Disclosure No. 24,220 (June, 1984) and pyrazolo pyrazoles described in Research Disclosure No. 24,230 (June, 1984). Imidazopyrazoles and pyrazolo [1,5-b] [1,2,4] triazoles described in JP-B No. 59-162548 have a small intensity of the secondary absorption in yellow and preferably have a high fastness to light.

Examples of the cyan coupler used for the present invention includes an oil protect naphthole type or phenol type coupler, a naphthole type coupler disclosed in U.S. Pat. No. 2,474,293, preferably an oxygen atom eliminated highly active two equivalent naphthole type coupler disclosed in U.S. Pat. Nos. 4,052,212, 4,143,396, 4,228,233 and 4,296,200. An example of the phenol type coupler includes a coupler described in U.S. Pat. Nos. 2,369,929, 2,423,730, 2,772,162, 2,801,171 and 2,895,826. The cyan coupler which is fast to temperature and moisture is preferred. Such coupler may include, for example, a phenol type cyan coupler described in U.S. Pat. No. 3,772,022, 2,5-diacylamino substituted phenol type coupler described in U.S. Pat. Nos. 2,772,162, 3,758,308, 4,126,396 and 4,327,137 and JP-A No. 59-166956, and a phenol type coupler having a phenyl ureide group at a second position and an acylamino group at a fifth position described in U.S. Pat. Nos. 3,446,622, 4,333,999, 4,451,559 and 4,427,767.

A preferred specific example of the coupler used for the present invention includes the coupler described in WO 93/12465.

The coupler used for the present invention can be introduced into the silver halide emulsion by various dispersion methods. For example, a solid dispersion method, an alkali dispersion method, preferably a latex dispersion method, more preferably an oil-in-water dispersion method are cited. In the oil-in-water dispersion method, the coupler is dissolved in an organic solvent having a high boiling point of 175° C. or more or in an auxiliary solvent having a low boiling point, or in a mixture thereof and is then finely dispersed in aqueous medium such as water or a gelatin solution in the presence of a surfactant. An example of the organic solvent having the high boiling point is described in U.S. Pat. No. 2,322,027. The dispersion may accompany a phase inversion, and the auxiliary solvent can be removed or reduced by distillation, a noodle wash, or ultrafiltration as required, and can be used for coating.

In the silver halide photographic material of the present invention, a mol ratio of the yellow coupler (Y), the magenta coupler (M) and the cyan coupler (C) is Y:M C=2.0 to 4.0:1:2.0 to 4.5.

Examples of the organic solvent having a high boiling point include phthalate ester (i.e., dibutyl phthalate, dicyclohexyl phthalate, di-2-ethyl hexyl phthalate, didodecyl phthalate), ester of a phosphoric acid or a phosphonic acid (i.e., triphenyl phosphate, tricresyl phosphate, 2-ethylhexyldiphenyl phosphate, tricyclohexyl phosphate, tri-2-ethylhexyl phosphate, trididecyl phosphate, tributoxyethyl phosphate, trichloropropyl phosphate, di-2-ethylhexylphenyl phosphate), benzoic ester (i.e., 2-ethylhexyl benzoate, dodecyl benzoate, 2-ethyloxyl-p-hydroxy benzoate), an amide (i.e., diethyldodecane amide, N-tetradecyl pyrrolidone), alcohol or phenol (i.e., isostearyl alcohol, 2,4-di-t-amyl phenol), aliphatic calboxylate ester (i.e., dioctyl azelate, glycerol tributylate, isostearyl lactate, trioctyl citrate), an aniline derivative (i.e., N,N-dibutyl-2-butoxy-5-t-octyl aniline), a hydrocarbon (paraffin, dodecyl benzene, diisopropyl naphthalene).

The auxiliary solvent has a boiling point of about 30° C. to about 60° C. Such auxiliary solvent may include, for example, ethyl acetate, butyl acetate, ethyl propionate, methyl ethyl ketone, cyclohexanone, 2-ethoxy ethyl acetate, dimethyl formamide and the like.

Steps and effects of the latex dispersion method and examples of latex for impregnation are described in U.S. Pat. No. 4,199,363, DE-A No. 2,541,274 and No. 2,541,230.

As a binder or a protective colloid used for the emulsion layer of the photographic material and the non-photosensitive hydrophilic colloidal layer of the present invention, gelatin is mainly used. Alternatively, a gelatin derivative, protein such as albumin and casein, a cellulose derivative such as ethyl cellulose and carboxy methyl cellulose, a sugar derivative such as a starch derivative, a hydrophilic homopolymer or copolymer such as polyvinyl alcohol, a polyacrylate, a polyacryl amide, and a polymethacrylate can be used.

Various compounds can be added to the photographic material emulsion layer and the non-photosensitive hydrophilic colloidal layer of the present invention in order to avoid fog during process steps, storage or development, or to stabilize photograph performance. Examples of such compounds include conventionally well-known compounds as an anti-fogging agent or a stabilizer such as azoles, i.e., nitroindazoles, nitrobenzimidazoles, mercaptothiazoles, mercaptobenzimidazoles, mercaptothiadiazoles, aminotriazoles, benzotriazoles, mercaptotetrazoles (especially, 1-phenyl-5-mercaptotetrazoles); mercaptotriazines; thioketones; azaindenes, i.e., triazaindens, tetraazaindenes (especially, 4-hydroxy-1,3,3a,7-tetraazaindenes); pentaazaindens; a benzenethiosulfonic acid; a benzenesulfinic acid; a benzene sulfonic acid amide. Especially preferred is benzotriazoles and nitroindazoles. These compounds may be included in a treating solution used for development.

The photographic material emulsion layer and the non-photosensitive hydrophilic colloidal layer of the present invention can include a hydroquinone derivative, an amino phenol derivative, a gallic acid derivative, an ascorbic acid derivative and the like as the anti-fogging agent.

The photographic material emulsion layer and the non-photosensitive hydrophilic colloidal layer of the present invention can include an inorganic or organic hardening agent. Such hardening agent may include, for example, a chromium salt (i.e., chromium alum), an N-methylol compound, a dioxane derivative, an active vinyl compound (i.e., 1,2,5-triacryloyl-hexahydro-s-triazine, 1,3-vinylsulfonyl-2-propanole), mucohalogen acids (i.e., a mucochloric acid, a mucophenoxychloric acid). These hardening agents can be used singly or in combination.

The photographic material emulsion layer and the non-photosensitive hydrophilic colloidal layer of the present invention can include a surfactant as a coating auxiliary, an antistatic agent, a sliding improving agent, an emulsifier, a dispersant, an adhesion inhibitor and a photographic property (i.e., development promotion, contrasty, sensitizing) improving agent. Examples of the surfactant include a nonionic surfactant such as saponin, an alkylene oxide derivative (i.e., polyethylene glycol, polyethylene glycol alkylethers), a glycidol derivative (i.e., alkenyl succinate polyglyceride, alkylphenol polyglyceride), fatty acid esters of polyhydric alcohols, alkyl esters of sugar; an anionic surfactant having an acidic group, i.e., a carboxylic group, a sulfo group, a sulfuric ester group, a phosphoric ester group such as an alkyl carboxyate, alkyl sulfuric esters, alkyl phosphoric esters; an amphoteric surfactant such as amino acids, aminoalkyl sulfonic acids, a aminoalkyl sulfuric acid or phosphoric esters; a cationic surf actant such as aliphatic or aromatic quaternary ammonium salts, or heterocyclic quaternary ammonium salts.

The photographic material emulsion layer and the non-photosensitive hydrophilic colloidal layer of the present invention can include a soluble or refractory synthetic polymer dispersion to improve dimensional stability. For example, a polymer having a monomer component of alkyl (meth) acrylate, alkoxyalkyl (meth) acrylate, (meth) acrylamide, vinylester, glycidiyl (meth) acrylate, acrylonitrile, styrene singly or in combination, or a combination of an acrylic acid, a methacrylic acid, an α, β-unsaturated dicarboxylic acid, a styrene sulfonic acid with them.

Examples of the non-photosensitive hydrophilic colloidal layer of the present invention include a protective layer, an intermediate layer, a ultraviolet ray absorbing layer, a yellow filter layer, an antihalation layer, an antistatic layer or the like. The protective layer can include a mat agent to inhibit adhesion and improve a surface condition. Examples of the mat agent include particulates such as a polymethylmetacrylate homopolymer, a copolymer of methylmethacrylate and a methacryl acid, starch, silica, magnesium oxide described in U.S. Pat. Nos. 2,701,245, 2,992,101, 4,142,894 and 4,396,706. A silicone compound described in U.S. Pat. Nos. 3,489,576 and 4,047,958, a colloidal silica described in JP-B No. 56-23139 and other paraffin wax, higher fatty acid ester and the like can be added to the protective layer.

The photographic material of the present invention may include a ultraviolet absorbing agent in the non-photosensitive hydrophilic colloidal layer. For example, benzotriazoles substituted with an aryl group described in U.S. Pat. Nos. 3,533,794 and 4,236,013, JP-B No. 51-6540, and EP Patent No. 57, 160; butadienes described in U.S. Pat. No. 4,195,999; cinnamic acid esters described in U.S. Pat. Nos. 3,705,805 and 3,707,375; benzophenones described in U.S. Pat. No. 3,215,230 and GB Patent No. 1,321,355; and a polymer having a ultraviolet absorbing group described in U.S. Pat. Nos. 3,761,272 and 4,431,726. A ultraviolet absorbing fluorescent whitening agent described in U.S. Pat. Nos. 3,499,762 and 3,700,455 may be used.

The photographic material of the present invention may include an aqueous dye as a filter dye in the non-photosensitive hydrophilic colloidal layer to prevent irradiation and to attain other various purposes. Examples of the dye include an oxonol dye, a hemioxonol dye, a styryl dye, a merocyanine dye, a cyanine dye and an azo dye. Specifically, the oxonol dye, the hemioxonol dye and the merocyanine dye are useful.

According to the photographic material of the present invention, a discoloring inhibitor can be used in the emulsion layer and the non-photosensitive hydrophilic colloidal layer. One or more kinds of the discoloring inhibitor may be used. Examples of the discoloring inhibitor include phenols or a phenyl ethers described in JP-A No. 59-125732, a metal complex described in JP-A No. 60-97353, a hindered amine or a hindered phenol compound described in JP-A No. 62-115157, and a metal complex described in JP-A No. 61-140941.

The photographic material emulsion layer and the non-photosensitive hydrophilic colloidal layer of the present invention can include polyols such as trimethylolpropane, pentanediol, butanediol, ethyleneglycol, glycerin as a plasticizer. In addition, a fluorescent whitening agent, a development accelerators, a pH regulator, a thickener, an antistatic agent or the like can be added to the emulsion layer and the hydrophilic colloidal layer.

As a support used for the photosensitive material of the present invention, a film composed of a synthetic polymer such as cellulose triacetate, cellulose diacetate, nitrocellulose, polystylene, polyethylene terephthalate, polycarbonate; baryta paper; α-olefinic polymer (i.e., polyethylene, polypropylene) coated or laminated paper; synthetic paper and the like can be used. The support may be colored with a dye or a pigment. When these supports are used for a reflecting material, a white pigment is preferably added to the support or a laminated layer thereof. Examples of the white pigment include titanium dioxide, barium sulfate, zinc oxide, zinc sulfide, calcium carbonate, antimony trioxide, silica white, alumina white and titanium phosphate. Specifically, titanium dioxide, barium sulfate and zinc oxide are useful.

A surface of the support is generally under-coated in order to enhance the adhesion of the photographic emulsion. Before or after the under-coating, the surface of the support may be treated with a corona discharge or a ultraviolet ray radiation. When the support is used for the reflecting material, a hydrophilic colloidal layer containing a white pigment at high density is formed between the support and the emulsion layer, thereby improving whiteness and sharpness of the photographic image.

When a synthetic resin film kneaded with a white pigment is used for the photographic material of the present invention, an photographic image can be obtained with an improvement in smoothness, luster and sharpness as well as an excellent fineness, a good delineation of shadow and a good image in the dark. As the synthetic resin film, polyethylene terephthalate and cellulose acetate are especially useful. As the white pigment, barium sulfate and titanium oxide are especially useful.

The silver halide photographic material of the present invention forms a monochrome image by exposing an monochrome negative firm or a color negative film.

A color developer used for the present invention is preferably an alkali solution mainly containing an aromatic primary amine developing agent. Examples of the developing agent include 4-amino-N,N-diethyl aniline, 3-methyl-4-amino-N,N-diethyl aniline, 4-amino-N-ethyl-N-β-hydroxyethylaniline, 3-methyl-4-amino-N-ethyl-N-β-hydroxyethylaniline, 3-methyl-4-amino-N-ethyl-N-β-metanesulfonamidoethylaniline, 4-amino-3-methyl-N-ethyl-N-β-methoxyethylaniline.

The color developer may include a pH buffer such as carbonate, borate and phosphate and an anti-fogging agent such as bromide, iodide and an organic anti-fogging agent. Further, the solution may include, if necessary, a water softener, a sulphite of an alkali metal, an accelerator such as diethylene glycol, polyethylene glycol, a quaternary ammonium salt and amines, a competing coupler, a fogging agent such as sodium boron hydride, an auxiliary developing agent such as 1-phenyl-3-pyrazolidone, a tackifier, a polycarboxylic acid type chelating agent described in U.S. Pat. No. 4,082,723 and an antioxidant described in DE-A No. 2,622,950. "The developer is substantially free of benzyl alcohol" means that 5 ml/l or less of benzyl alcohol exists, if contained, in the developer. More preferably, the developer contains no benzyl alcohol.

The silver halide photographic material of the present invention is generally bleached after a color development. Bleaching may be conducted concurrently with/or separately from fixing. As the bleaching agent, for example, a polyvalent metal compound such as iron (III), cobalt (III), chromium (VI) and copper (II); peracids; quinones; a nitroso compound or the like is used. For example, ferricyanide; dichromate; an organic acid salt of iron (III) or cobalt (III), i.e., aminopolycarbonic acids such as ethylenediamine tetraacetate, a nitrilotriacetic acid, 1,3-diamino-2-propanol tetraacetate; a complex salt of an organic acid such as a citric acid, a tartaric acid and a malic acid; persulfate; manganate; nitrosophenol or the like can be used. Among them, sodium ethylenediamine tetraacetate (III) and ammonium ethylenediamine tetraacetate (III) are especially useful. The ethylenediamine tetraacetate (III) complex salt is useful both for an independent bleach solution and a monobath bleach fixer. After the color development or the bleach-fix, water washing may be conducted. The color development can be at any temperature ranging from 18° C. to 55° C. The color development is conducted preferably 30° C. or more, more preferably 35° C. or more. Developing time is within about one minute and 30 seconds to about 20 seconds, and shorter time is preferred. In case of continuous development, the solution is preferably replenished, preferably in an amount of 30 to 200 ml, more preferably 50 ml to 150 ml per square meter of a treated area. The bleach-fix can be conducted at any temperature ranging from 18° C. to 50° C., preferably 30° C. or more. If the temperature is 35° C. or more, a treating time can be within 1 minute and an amount of the liquid replenished can be reduced. The water wash after the color development and the bleach-fix is generally within 1 minute and can be within 1 minute using a stabilizing bath.

Formed dyes are not only deteriorated by light, heat or moisture, but also discolored by mould during a storage. The cyan dye is especially deteriorated by the mould, therefore a fungicide is preferably used. A specific example of the fungicide includes 2-thiazolylbenzimidazoles described in JP-A No. 57-157244. The fungicide may be included in the silver halide photosensitive material or may be added externally during the developing step. Coexisting with the processed photosensitive material, the fungicide can be added at any step.

EXAMPLES

The present invention will be described based on the following examples.

Example 1

An silver chloride/bromide emulsion (a monodisperse cube, having an average grain size of 0.5$\mu$m, containing 0.9 mol % of silver bromide; $1\times10^{-5}$ mol of a potassium hexachloroiridium (IV) acid per 1 mol of silver is contained over a surface of grains) was prepared and sodium thiosulfate was added thereto to conduct optimal chemical sensitizing. To the emulsion, $1\times10^{-4}$ mol of a sensitizing dye A, $1.3\times10^{-4}$ mol of a sensitizing dye B and $4\times10^{-5}$ mol of a sensitizing dye C per 1 mol of silver were added. After leaving 20 minutes, 50 mg of 4-hydroxy-6-methyl-1,3,3a,7-tetraazaindene per 1 mol of silver halide was added thereto as a stabilizer.

sensitizing dye A

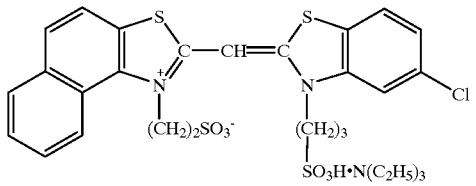

sensitizing dye B

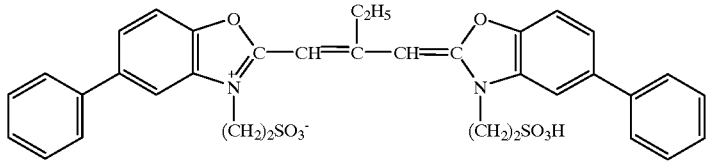

sensitizing dye C

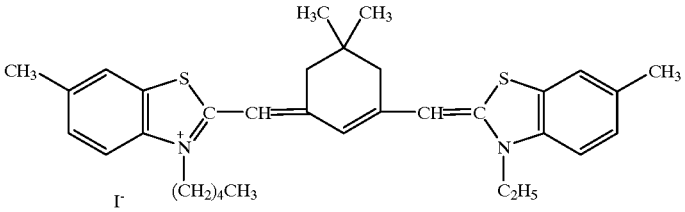

A coupler dispersion was prepared as follows:

After a coupler was dissolved in dibutylphthalate and ethyl acetate, the coupler was added to a gelatin solution in the presence of a surfactant and was microdispersed using a ultrasonic wave homogenizer.

The silver halide emulsion and the coupler dispersion were mixed and three layers having the following constructions were simultaneously coated on polyethylene coated paper.

| Top protective layer | |
|---|---|
| Gelatin | 1.0 g/m$^2$ |
| Cited compounds | shown in Table 1 |
| **Ultraviolet ray absorbing layer** | |
| Ultraviolet ray absorbent A | 0.15 g/m$^2$ |
| Ultraviolet ray absorbent B | 0.20 g/m$^2$ |
| High boiling solvent | 0.2 g/m$^2$ |
| Gelatin | 0.6 g/m$^2$ |

-continued

| Silver halide emulsion layer | |
|---|---|
| Silver halide emulsion | silver 0.7 g/m$^2$ |
| Coupler (C-1) | 0.37 g/m$^2$ |
| Coupler (M-1) | 0.17 g/m$^2$ |
| Coupler (Y-1) | 0.68 g/m$^2$ |
| High boiling solvent | 1 g/m$^2$ |
| Gelatin | 1.5 g/m$^2$ |
| Irradiation protect dye A | 0.03 g/m$^2$ |
| Irradiation protect dye B | 0.03 g/m$^2$ |
| Cited compounds | shown in Table 1 |
| Support Polyethylene coated paper | |

The couplers and the other additives used are as follows:

High boiling solvent n-dibutylphthalate

C-1

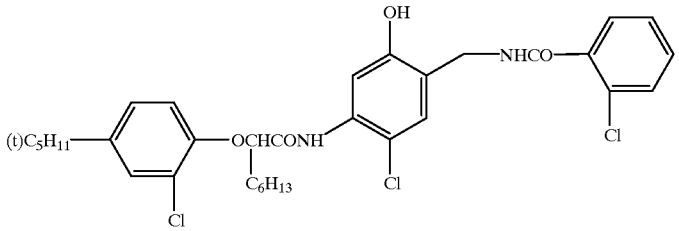

M-1

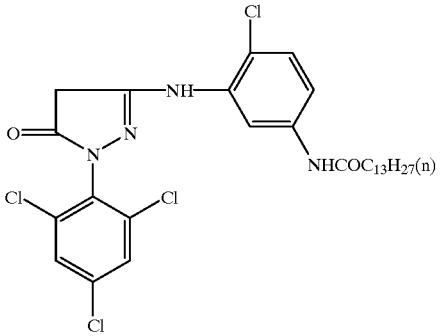

Y-1

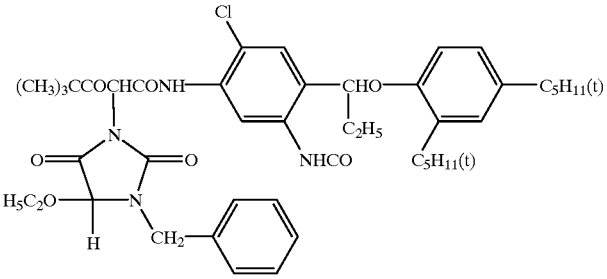

Irradiation protect dye A

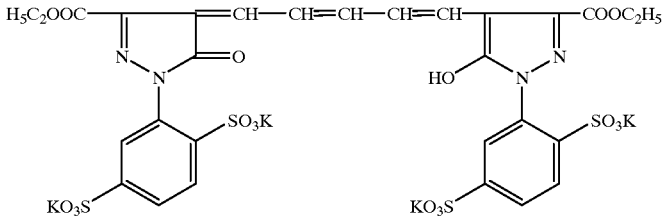

-continued

Irradiation protect dye B

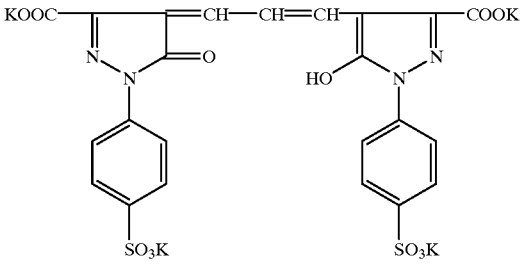

Ultraviolet ray absorbent A

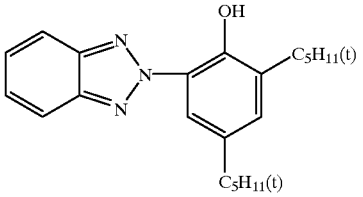

Ultraviolet ray absorbent B

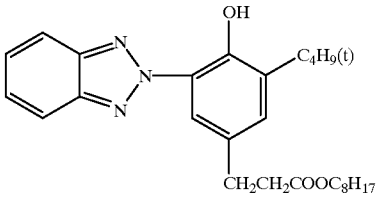

Comparative compound A

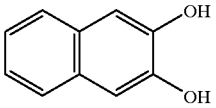

TABLE 1

| sample No. | cited compounds in the protective layer (mg/m$^{2)}$ | cited compounds in the emulsion layer (mg/m$^{2)}$ |
|---|---|---|
| 1 (Comparative) | comparative compound B (20) | none |
| 2 (Comparative) | comparative compound A (300) comparative compound B (20) | comparative compound A (300) |
| 3 (Comparative) | I-1 (300) comparative compound B (20) | none |
| 4 (Comparative) | I-1 (600) comparative compound B (20) | none |
| 5 (Comparative) | comparative compound B (20) | I-1 (300) |
| 6 (Comparative) | comparative compound B (20) | I-1 (600) |
| 7 (Comparative) | I-1 (300) comparative compound B (20) | I-1 (300) |
| 8 (Comparative) | I-1 (600) comparative compound B (20) | I-1 (600) |
| 9 (Comparative) | comparative compound B (20) | comparative compound B (30) |
| 10 (Comparative) | III-1 (20) | III-1 (30) |
| 11 (Comparative) | comparative compound B (20) | I-1 (300) comparative compound B (20) |
| 12 (Invention) | III-1 (20) | I-1 (300) III-1 (30) |
| 13 (Invention) | III-1 (20) | I-1 (600) III-1 (30) |
| 14 (Comparative) | I-1 (300) comparative compound B (20) | I-1 (300) comparative compound B (20) |
| 15 (Invention) | I-1 (300) III-1 (20) | I-1 (300) III-1 (30) |

Samples 1 to 15 were prepared and treated as follows:

Treatment 1

A liquid containing 300 ml of 35% glycerin solution was placed on a bottom of each sample. Each sample was kept for 3 days at 30° C. in a closed vessel filled with air which was equilibrium with the liquid.

Treatment 2

A liquid containing 6 ml of 40% formaldehyde per 300 ml of 35% glycerin solution was placed on a bottom of each sample. Each sample was kept for 3 days at 30° C. in a closed vessel fulfilled with air which was equilibrium with the liquid.

Treatment 3

Each sample was kept for 72 hours at 25° C., RH 60%.

Treatment 4

Each sample was kept for 72 hours at 60° C., RH 60%.

Each sample treated with the four types of treatments described above was exposed through an optical wedge using sensitometry actinometer (light-source color, temperature of 3200K), was color developed, was bleach fixed, was water washed and was then dried.

| Treatment step | Treating temperature | Treating time |
|---|---|---|
| Color development | 35° C. | 45 sec |
| Bleach-fix | 35° C. | 45 sec |
| Water wash | 35° C. | 90 sec |

| Color developer | |
|---|---|
| 4-amino-3-methyl-N-ethyl-N-(β-methylsulfoneamidoethyl)aniline sesquisulfate monohydrate | 6.1 g |
| Triethanol amine | 8.2 g |
| Nitrilotriacetic acid | 1.5 g |
| 1-hydroxyethylidene-1,1'-diphosphon acid (60% solution) | 1.6 g |
| Potassium hydroxide | 4.2 g |
| Chinopal SFP | 0.8 g |
| Potassium carbonate | 0.9 g |
| N,N-dietylhydroxylamine | 4.0 g |

To the above solution, water was added to be 1 1 and a 10% sulfuric acid or a 20% potassium hydroxide solution was then added to adjust to pH 10.10. The Chinopal SFP is a fluorescent whitening agent available from Chiba-Geigy Actiene Gesellshaft Co., Ltd.

| Bleach-fix | |
|---|---|
| Iron sodium ethylenediaminetetraacetate monohydrate | 48.0 g |
| Disodium ethylenediaminetetraacetate dihydrate | 24.0 g |
| Ammonium thiosulphate (70% solution) | 148 ml |
| Sodium hydrogen sulfite (anhydrous) | 15.0 g |

To the above solution, water was added to be 1 1 and a 25% aqueous ammonia or a 90% acetic acid was added to adjust to pH 6.10.

| Washing solution | |
|---|---|
| Methanol | 4.0 ml |
| p-hydroxybenzoic acid-n-butylester | 0.01 g |
| Thiabendazole | 0.10 g |
| Ethyleneglycol | 6.0 ml |

To the above solution, water was added to be 1 1. The pH was 7.45.

Maximum densities of yellow, magenta and cyan in each sample treated by Treatment 1 and 2 were measured using a Macbeth RD 918 densitometer and a color tone of each sample was examined. Results are shown in Tables 2 and 3. Black densities in each sample treated by Treatment 3 and 4 were measured using the Macbeth RD 918 densitometer. A numerical value that an inverse number of light exposure to obtain a density of fog +0.6 was multiplied by one hundred was determined. The value of sample 1 treated by Treatment 3 was to be 100. Results are shown in Tables 4 and 5.

TABLE 2

(Treatment 1)

| sample No. | density of yellow | density of magenta | density of cyan | color tone on whole surface | color tone on rims |
|---|---|---|---|---|---|
| 1 (Comparative) | 2.51 | 2.62 | 2.56 | black | black |
| 2 (Comparative) | 2.53 | 2.64 | 2.54 | black | black |
| 3 (Comparative) | 2.48 | 2.61 | 2.50 | black | black |
| 4 (Comparative) | 2.53 | 2.61 | 2.55 | black | black |
| 5 (Comparative) | 2.49 | 2.58 | 2.51 | black | black |
| 6 (Comparative) | 2.53 | 2.65 | 2.57 | black | black |
| 7 (Comparative) | 2.50 | 2.60 | 2.54 | black | black |
| 8 (Comparative) | 2.45 | 2.55 | 2.53 | black | black |
| 9 (Comparative) | 2.50 | 2.57 | 2.54 | black | black |
| 10 (Comparative) | 2.49 | 2.53 | 2.50 | black | black |
| 11 (Comparative) | 2.51 | 2.56 | 2.54 | black | black |
| 12 (Invention) | 2.48 | 2.51 | 2.50 | black | black |
| 13 (Invention) | 2.49 | 2.53 | 2.49 | black | black |
| 14 (Comparative) | 2.52 | 2.57 | 2.54 | black | black |
| 15 (Invention) | 2.50 | 2.55 | 2.52 | black | black |

TABLE 3

(Treatment 2)

| sample No. | density of yellow | density of magenta | density of cyan | color tone on whole surface | color tone on rims |
|---|---|---|---|---|---|
| 16 (Comparative) | 2.45 | 1.37 | 2.40 | green | green |
| 2 (Comparative) | 2.47 | 1.65 | 2.41 | green | green |
| 3 (Comparative) | 2.46 | 2.58 | 2.47 | black | green |

TABLE 3-continued (Treatment 2)

| sample No. | density of yellow | density of magenta | density of cyan | color tone on whole surface | color tone on rims |
|---|---|---|---|---|---|
| 4 (Comparative) | 2.50 | 2.59 | 2.53 | black | green |
| 5 (Comparative) | 2.48 | 2.55 | 2.49 | black | black |
| 6 (Comparative) | 2.51 | 2.63 | 2.55 | black | black |
| 7 (Comparative) | 2.50 | 2.58 | 2.53 | black | black |
| 8 (Comparative) | 2.45 | 2.55 | 2.53 | black | black |
| 9 (Comparative) | 2.44 | 1.70 | 2.51 | green | green |
| 10 (Comparative) | 2.43 | 1.75 | 2.48 | green | green |
| 11 (Comparative) | 2.53 | 2.58 | 2.55 | black | black |
| 12 (Invention) | 2.51 | 2.53 | 2.51 | black | black |
| 13 (Invention) | 2.48 | 2.51 | 2.50 | black | black |
| 14 (Comparative) | 2.53 | 2.59 | 2.57 | black | black |
| 15 (Invention) | 2.51 | 2.58 | 2.54 | black | black |

TABLE 4

(Treatment 3)

| sample No. | sensitivity | fog |
|---|---|---|
| 1 (Comparative) | 100 | 0.08 |
| 2 (Comparative) | 100 | 0.08 |
| 3 (Comparative) | 101 | 0.08 |
| 4 (Comparative) | 100 | 0.08 |
| 5 (Comparative) | 101 | 0.08 |
| 6 (Comparative) | 99 | 0.08 |
| 7 (Comparative) | 100 | 0.08 |
| 8 (Comparative) | 99 | 0.08 |
| 9 (Comparative) | 98 | 0.08 |
| 10 (Comparative) | 99 | 0.07 |
| 11 (Comparative) | 98 | 0.08 |
| 12 (Invention) | 100 | 0.07 |
| 13 (Invention) | 99 | 0.07 |
| 14 (Comparative) | 98 | 0.08 |
| 15 (Invention) | 99 | 0.07 |

TABLE 5

(Treatment 4)

| sample No. | sensitivity | fog |
|---|---|---|
| 1 (Comparative) | 123 | 0.13 |
| 2 (Comparative) | 124 | 0.12 |
| 3 (Comparative) | 165 | 0.11 |
| 4 (Comparative) | 170 | 0.13 |
| 5 (Comparative) | 158 | 0.12 |
| 6 (Comparative) | 175 | 0.11 |
| 7 (Comparative) | 168 | 0.13 |
| 8 (Comparative) | 155 | 0.12 |
| 9 (Comparative) | 135 | 0.11 |
| 10 (Comparative) | 97 | 0.08 |
| 11 (Comparative) | 145 | 0.12 |
| 12 (Invention) | 101 | 0.08 |
| 13 (Invention) | 103 | 0.08 |
| 14 (Comparative) | 157 | 0.13 |
| 15 (Invention) | 102 | 0.08 |

As apparent from Tables 2 to 5, when the samples 1 and 10 that contain no compound represented by the formula (I) of the present invention, the sample 2 containing a comparative compound A and the sample 9 containing a comparative compound B were treated by Treatment 2, they had a significantly decreased magenta density and had green color tones on whole surfaces and rims. When the samples 3 and 4 containing the compound represented by the formula (I) of the present invention only in the protective layers were treated by Treatment 2, they had black color tones on whole surfaces but had green color tones on rims. When the samples 5, 6, 11, 12 and 13 that contain the compound represented by the formula (I) of the present invention in the emulsion layers and the samples 7, 8, 14 and 15 that contain the same in both the emulsion layers and the protective layers were treated by Treatment 2, they had black color tones on both whole surfaces and rims with no change. When the samples 1 to 9, 11 and 14 that contain no compound represented by the formula (III) of the present invention were treated by Treatment 3 and 4, they had a great sensitivity change; especially by Treatment 4, they had an increased fog. When the samples 12, 13 and 15 that contain the compound represented by the formula (I) of the present invention in the emulsion layers or both the emulsion layers and the protective layers and also contain the compound represented by the formula (III) of the present invention were treated by Treatment 1 and 2, they had no change in color tones and were black on whole surfaces and rims. When they were treated by Treatment 3 and 4, they had a less sensitivity change and, by Treatment 4, had a less increased fog.

Example 2

Samples 16 to 25 were prepared as Example 1 except that the couplers of the sample 1 in Example 1 were replaced with the following C-2 (an additive amount is 0.33 g/m$^2$), M-2 (an additive amount is 0.15 g/m$^2$) and Y-2 (an additive amount is 0.55 g/m$^2$) and the cited compounds of the sample 1 were replaced with the compounds shown in Table 6.

C-2

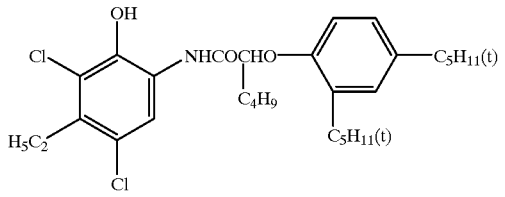

M-2

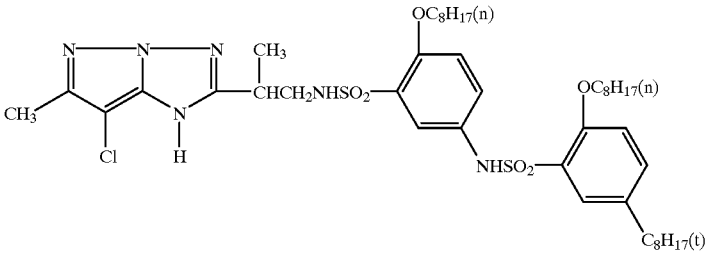

Y-2

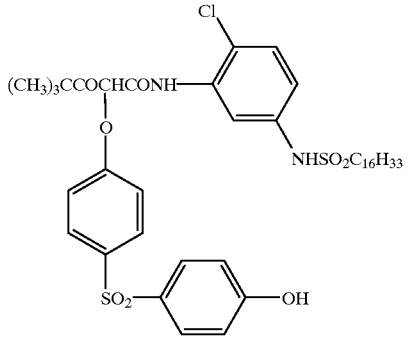

TABLE 6

| sample No. | cited compounds in the protective layer ($mg/m^2$) | cited compounds in the emulsion layer layer ($mg/m^2$) |
|---|---|---|
| 16 (Comparative) | comparative compound B(20) | none |
| 17 (Comparative) | II-1 (500) comparative compound B (20) | none |
| 18 (Comparative) | comparative compound B (20) | II-1 (500) |
| 19 (Comparative) | II-1 (500) comparative compound B (20) | II-1 (500) comparative compound B (30) |
| 20 (Comparative) | comparative compound B (20) | comparative compound B (30) |
| 21 (Comparative) | IV-1 (20) | IV-1 (30) |
| 22 (Comparative) | comparative compound B (20) | II-1 (500) comparative compound B (20) |

TABLE 6-continued

| sample No. | cited compounds in the protective layer ($mg/m^2$) | cited compounds in the emulsion layer layer ($mg/m^2$) |
|---|---|---|
| 23 (Invention) | IV-1 (20) | II-1 (500) IV-1 (30) |
| 24 (Comparative) | II-1 (500) comparative compound B (20) | comparative compound B (30) |
| 25 (Invention) | II-1 (500) IV-1 (20) | II-1 (500) IV-1 (30) |

As in Example 1, the samples 16 to 25 were treated by Treatment 1 and 2 and were exposed and developed. Maximum densities of yellow, magenta and cyan in each sample obtained were measured using the Macbeth RD 918 densitometer and a color tone of each sample was examined. Results are shown in Tables 7 and 8.

TABLE 7

(Treatment 1)

| sample No. | density of yellow | density of magenta | density of cyan | color tone on whole surface | color tone on rims |
|---|---|---|---|---|---|
| 16 (Comparative) | 2.51 | 2.62 | 2.56 | black | black |
| 17 (Comparative) | 2.55 | 2.61 | 2.58 | black | black |
| 18 (Comparative) | 2.54 | 2.60 | 2.57 | black | black |
| 19 (Comparative) | 2.52 | 2.58 | 2.55 | black | black |
| 20 (Comparative) | 2.50 | 2.59 | 2.53 | black | black |
| 21 (Comparative) | 2.51 | 2.60 | 2.55 | black | black |
| 22 (Comparative) | 2.53 | 2.59 | 2.57 | black | black |
| 23 (Invention) | 2.52 | 2.57 | 2.55 | black | black |
| 24 (Comparative) | 2.53 | 2.61 | 2.54 | black | black |
| 25 (Invention) | 2.50 | 2.60 | 2.58 | black | black |

TABLE 8

(Treatment 2)

| sample No. | density of yellow | density of magenta | density of cyan | color tone on whole surface | color tone on rims |
|---|---|---|---|---|---|
| 16 (Comparative) | 2.45 | 1.37 | 2.40 | green | green |
| 17 (Comparative) | 2.53 | 2.57 | 2.54 | black | green |
| 18 (Comparative) | 2.52 | 2.58 | 2.54 | black | black |
| 19 (Comparative) | 2.51 | 2.59 | 2.53 | black | black |
| 20 (Comparative) | 2.49 | 1.53 | 2.51 | green | green |
| 21 (Comparative) | 2.49 | 1.63 | 2.53 | green | green |
| 22 (Comparative) | 2.51 | 2.57 | 2.56 | black | black |
| 23 (Invention) | 2.51 | 2.55 | 2.52 | black | black |
| 24 (Comparative) | 2.50 | 2.59 | 2.53 | black | green |
| 25 (Invention) | 2.49 | 2.59 | 2.55 | black | black |

The samples 16 to 25 were treated by Treatment 3 and 4 as in Example 1. The samples were exposed and developed as in Example 1. A black density in each sample treated was measured using the Macbeth RD 918 densitometer. A numerical value that an inverse number of light exposure to obtain a density of fog +0.6 was multiplied by one hundred was determined. The value of sample 16 treated by Treatment 3 was to be 100, which is a relative sensitivity of each sample. Results are shown in Tables 9 and 10.

TABLE 9

(Treatment 3)

| sample No. | sensitivity | fog |
|---|---|---|
| 16 (Comparative) | 100 | 0.08 |
| 17 (Comparative) | 101 | 0.08 |
| 18 (Comparative) | 102 | 0.08 |
| 19 (Comparative) | 102 | 0.08 |
| 20 (Comparative) | 99 | 0.08 |
| 21 (Comparative) | 99 | 0.08 |
| 22 (Comparative) | 100 | 0.08 |
| 23 (Invention) | 99 | 0.07 |
| 24 (Comparative) | 101 | 0.08 |
| 25 (Invention) | 100 | 0.07 |

TABLE 10

(Treatment 4)

| sample No. | sensitivity | fog |
|---|---|---|
| 16 (Comparative) | 128 | 0.13 |
| 17 (Comparative) | 153 | 0.12 |

TABLE 10-continued (Treatment 4)

| sample No. | sensitivity | fog |
|---|---|---|
| 18 (Comparative) | 165 | 0.12 |
| 19 (Comparative) | 178 | 0.12 |
| 20 (Comparative) | 135 | 0.12 |
| 21 (Comparative) | 105 | 0.08 |
| 22 (Comparative) | 161 | 0.12 |
| 23 (Invention) | 101 | 0.08 |
| 24 (Comparative) | 157 | 0.13 |
| 25 (Invention) | 102 | 0.08 |

As apparent from Tables 7 to 10, when the samples 16 and 21 that contain no compound represented by the formula (II) of the present invention and the sample 20 containing the comparative compound B were treated by Treatment 2, they had a significantly decreased magenta density and had green color tones on whole surfaces and rims. Regarding the samples 17 and 24 containing the compound represented by the formula (II) of the present invention only in the protective layers, they had black color tones on whole surfaces but had green color tones on rims. When the samples 18, 22 and 23 that contain the compound represented by the formula (II) of the present invention in the emulsion layers and the samples 19 and 25 that contain the same in both the emulsion layers and the protective layers were treated by Treatment 2, they had black color tones on both whole surfaces and rims with no change. When the samples 17, 18, 19, 22 and 24 that contain the compound represented by the formula (II) of the present invention and contain no compound represented by the formula (IV) of the present invention were treated by Treatment 3 and 4, they had a great sensitivity change and an increased fogging. When the samples 23 and 25 that contain the compound represented by the formula (II) of the present invention in the emulsion layers or both the emulsion layers and the protective layers and also contain the compound represented by the formula (IV) of the present invention were treated by Treatment 1 and 2, they had less change in color tones and were black on whole surfaces and rims. When they were treated by Treatment 3 and 4, they had a less sensitivity change and had a less increased fogging.

According to the present invention, even if the silver halide photographic material is treated with a color developer substantially free of benzyl alcohol, a monochrome image using a dye image can be obtained. The monochrome image has a photographic property that is less deteriorated by a toxic gas such as formaldehyde, has a less change in sensitivity when stored under a high temperature condition and has a less increase in fog.

We claim:

1. A silver halide photographic material, comprising a support and at least one silver halide emulsion layer and at least one non-photosensitive hydrophilic colloidal layer, both provided on the support, silver halide grains of the silver halide emulsion layer including not less than 95% mol of silver chloride, the silver halide emulsion layer including a yellow coupler, a magenta coupler, a cyan coupler and at least one of the following compounds represented by the formula (I) or (II):

formula (I)

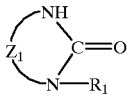

wherein $R_1$ represents a hydrogen atom, an alkyl group having 1 to 4 carbon atoms or an acyl group and $Z_1$ represents an ethylenic chain or a trimethine chain, formula (II)

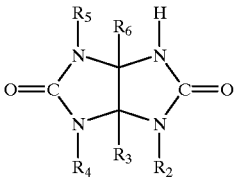

wherein $R_2$ to $R_6$ represent a hydrogen atom, an alkyl group having 1 to 4 carbon atoms, an aryl group or an aralkyl group, at least one of the silver halide emulsion layer and the non-photosensitive hydrophilic colloidal layer including at least one of the following compounds represented by the formula (III) or (IV):

formula (III)

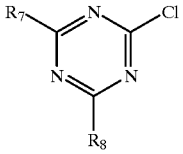

wherein $R_7$ represents a chlorine atom, a hydroxyl group, an alkyl group, an alkoxy group, an alkylthio group, an —OM group, M being a monovalent metal atom, $—NR_9R_{10}$ group or $—NHCOR_{11}$ group, $R_9$, $R_{10}$ or $R_{11}$ being a hydrogen atom, an alkyl group or an aryl group; $R_8$ represents the same as $R_7$ except the chlorine atom, formula (IV)

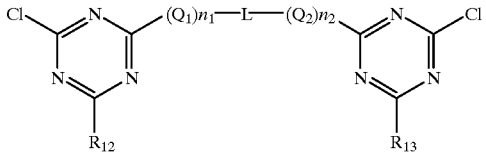

wherein $R_{12}$ and $R_{13}$ represent a chlorine atom, a hydroxyl group, an alkyl group, an alkoxy group or an —OM group, M being a monovalent metal atom, $Q_1$ and $Q_2$ represent —O—, —S—or —NH—, and L represents an alkylene group or an arylene group, $n_1$ and $n_2$ represent 0 or 1.

2. The material according to claim 1, wherein the non-photosensitive hydrophilic colloidal layer includes at least one of the compounds represented by the formula (I) or (II).

3. The material according to claim 1, which comprises the support, the emulsion layer, provided on the support and the colloidal layer, provided on the emulsion layer.

4. The material according to claim 1, which comprises the support, the colloidal layer, provided on the support, and the emulsion layer, provided on the colloidal layer.

5. A method for forming an image by comprising steps of exposing the material as defined in claim 1 to light carrying images and developing the material with a color developer substantially free of benzyl alcohol.

* * * * *